US005746103A

United States Patent [19]

Addison et al.

[11] Patent Number: 5,746,103

[45] Date of Patent: *May 5, 1998

[54] COIN ROLL OPENING DEVICE

[75] Inventors: Danny Hugh Addison, Durham; George Hufford, III, Clayton; Charles Martin McCray, Raleigh; Kevin L. Schultz, Raleigh; Craig Walton Turner, Raleigh, all of N.C.

[73] Assignee: International Business Machines Corporation, Armonk, N.Y.

[ * ] Notice: The term of this patent shall not extend beyond the expiration date of Pat. No. 5,609,086.

[21] Appl. No.: 709,560

[22] Filed: Aug. 1, 1996

Related U.S. Application Data

[63] Continuation of Ser. No. 415,954, Apr. 3, 1995, Pat. No. 5,609,086.

[51] Int. Cl.[6] ..... B26D 1/02

[52] U.S. Cl. ..... 83/440; 83/698.31; 83/856; 235/7 R

[58] Field of Search ..... 83/856, 698.31, 83/440; 30/336, 338, 339, 90.4, 92.5, 335, 340; 235/7 R

[56] References Cited

U.S. PATENT DOCUMENTS

| | | | |
|---|---|---|---|
| 2,711,019 | 6/1955 | Mirando | 30/342 |
| 3,187,431 | 6/1965 | Mattes | 30/342 |
| 3,781,987 | 1/1974 | Gentscheff | 30/2 |
| 3,898,733 | 8/1975 | Cormier | 30/90.4 |
| 4,001,934 | 1/1977 | Bell | 30/124 |
| 4,040,183 | 8/1977 | Cassier | 30/296.1 |
| 4,103,196 | 7/1978 | Smithline | 30/294 |
| 4,333,234 | 6/1982 | Smith | 30/2 |
| 4,382,330 | 5/1983 | Harbaugh | 30/124 |
| 4,536,957 | 8/1985 | Britton | 30/90.4 |
| 4,557,053 | 12/1985 | Hadlet, Jr. | 83/651.1 |
| 4,757,611 | 7/1988 | Tommi et al. | 30/2 |
| 4,825,738 | 5/1989 | Jones | 83/56 |
| 4,852,253 | 8/1989 | Uchida | 30/2 |
| 4,958,797 | 9/1990 | Lyons | 248/345.1 |
| 5,056,226 | 10/1991 | Gringer | 30/339 |
| 5,086,962 | 2/1992 | Costello | 225/93 |
| 5,123,320 | 6/1992 | Hochfeld | 83/856 |
| 5,330,493 | 7/1994 | Haining | 30/335 |
| 5,342,379 | 8/1994 | Volinski | 30/335 |
| 5,433,321 | 7/1995 | Abidin | 30/339 |
| 5,609,086 | 3/1997 | Addison et al. | 83/440 |

*Primary Examiner*—Kenneth E. Peterson
*Attorney, Agent, or Firm*—John D. Flynn

[57] ABSTRACT

A cash drawer having a coin roll opening device for opening a roll of coins quickly, conveniently and safely. The device includes a cash drawer having guides for receiving a coin roll. The cash drawer further includes a receptacle for receiving a blade assembly. The blade assembly having a blade and a blade holder. The blade assembly easily inserted and removed from the receptacle by use of the flexible arms of the blade holder. The blade holder is formed by two identical halves each having a male post, a post slot, a snap post and a snap arm for securing the blade. The blade having notches for receiving the male posts.

11 Claims, 6 Drawing Sheets

COIN ROLL OPENING DEVICE

This is a continuation of copending application Ser. No. 08/415,954 filed 3 Apr. 1995, now U.S. Pat. No. 5,609,086.

BACKGROUND OF THE INVENTION

1. Field of the Invention

The present invention relates to a device for safely, quickly and conveniently exposing and removing coins from a wrapped roll of coins and, more specifically to a device adapted for cutting, slicing, tearing, piercing or scoring the wrapper (made of paper, plastic, etc.) of a coin roll to facilitate opening of the coin roll and removal of coins therefrom.

2. Description of the Prior Art

It is common practice for banks and businesses to utilize coin wrappers or sheaths. The wrappers are manufactured of either paper or plastic, or any other suitable material, and in certain lengths and diameters so as to accommodate a given number of a particular coin denomination. For example, in the United States a penny wrapper is sized to have fifty pennies fitted into it. Other specially sized wrappers are available to have fitted therein given numbers of nickels, dimes and quarters (or the respective coins of other countries).

Once the coins are inserted into the wrapper, the ends of the wrapper are closed or otherwise turned under or reduced in size to complete the wrapping. The coins in such a wrapped roll can then be handled easily and in known dollar values, with assurance that the contents of the roll will not spill out.

In use, the wrapped roll of coins are distributed to cashiers who must, as a matter of course, make change for customers. When the cashier runs out of a certain coin denomination, a roll of that coin denomination is opened and its contents are spilled into the cash drawer for ready availability. How the coin roll is opened by the cashier forms the subject of the present invention. Typically, when a cashier needs to open a wrapped roll of coins, the coin roll will normally be firmly grasped and sharply banged indiscriminantly against an edge of a point-of-sale system, the cash drawer of the point of sale system or cash register, a counter top or other nearby object. As a result of this blow to the roll of coins, the wrapper is at least partly split or broken so that its contents can be easily removed.

Although this procedure is effective, it also is problematic for both the cashier and the object (against which the cashier chooses to smash the coin roll against in order to gain access to its contents) are subject to the resulting force from the blow. The multiple repeated blows delivered by the very hard coin roll can result in damage to the point-of-sale system (i.e., to the electronics of the POS, the drawer(s), drawer tracks, display(s), etc.), counter top or other object against which the coin roll is smashed. This smashing may also result in injury to the cashier.

This is particularly a problem with cash drawers. Cash drawers have become less sturdy and more complicated. The metal of cash drawers of times past has been typically replaced by plastic, and the sturdy internal mechanisms have been replaced by electronic elements that perform calculations and various other sensing and data processing functions. When a coin roll is banged against any part of the cash drawer, shock waves travel throughout the drawer to all components of the POS system. Such shocks may cause expensive-to-repair damage to not only the mechanical or structural components of the cash drawer, but also the electronics and other shock-sensitive components of the POS system, including sensitive display elements.

Countertops and other objects also have become more delicate. The hard wood of countertops and other sturdy objects of times past has been typically replaced by Formica or other less sturdy materials. These newer materials are not as capable of withstanding over the course of time multiple repeated blows from very hard objects such as metal coin rolls. Very often, the impact of the coin rolls physically damages the countertops or other objects.

Since the cashier may need to open quite a large number of coin rolls during the course of a business day, the repetition of shocks to the hands from repeated smashing, day after day, can result in injury to the cashier over a long period of time.

Coin roll openers known in the prior art include both hand held opening devices, such as those exemplified in U.S. Pat. Nos. 4,852,255 (Hochfeld), 4,852,253 (Uchida), 4,757,611 (Tommi et. al.) and 4,001,934 (Bell), and mountable devices, such as those exemplified in U.S. Pat. Nos. 4,825,738 (Jones), 4,382,330 (Harbaugh) and 4,040,183 (Cassier).

A problem with the known hand held opening devices of the prior art is the extra time and effort it requires to locate, handle and operate the devices. The result is that the hand held devices tend not to be used or are mislocated or misplaced. The problem with the known mountable devices of the prior art is that they too require operation motions to which cashiers are unaccustomed and thus, also tend not to be used. Moreover, the known prior art mountable devices further take up otherwise usable counter top or cashier space and may interfere with normal operations. Additionally the mountable devices usually provide that the blade is exposed or accessible when the device is not needed posing a safety hazard to the cashier.

SUMMARY OF THE INVENTION

It is an object of the present invention to provide a coin roll opening device for opening a roll of coins safely, quickly and conveniently.

It is a further object of the present invention to provide a coin roll opening device for opening a roll of coins safely, quickly and conveniently, without the typical smashing motion to which cashiers are presently accustomed.

It is still a further object of the present invention to provide a coin roll opening device for opening a roll of coins safely, quickly and conveniently, and which provides for opening the coin roll without the smashing motion so that the cashier doesn't indiscriminantly bang and cause damage to POS system, cash drawer, cash register, counter top or other object.

It is still a further object of the present invention to provide a coin roll opening device for opening a roll of coins safely, quickly and conveniently, and which provides for opening the coin roll so that the cashier is less likely to be injured from repeatedly opening the coin rolls.

It is still a further object of the present invention to provide a coin roll opening device for opening a roll of coins safely, quickly and conveniently, and which does not interfere with the counter top.

It is still a further object of the present invention to provide a coin roll opening device that does not occupy any counter top space.

It is still a further object of the present invention to provide a coin roll opening device for opening a roll of coins and in which the cashier safely, quickly and conveniently locate the device when needed.

It is still a further object of the present invention to provide a coin roll opening device for opening a roll of coins that is easily located when needed but out of the cashiers way when not needed.

It is still a further object of the present invention to provide a coin roll opening device for opening a roll of coins that is easy to service and maintain.

In accordance with a preferred embodiment of the present invention, a cash drawer having a coin roll opening device for opening a roll of coins quickly, conveniently and safely. The device includes a cash drawer having guides for receiving a coin roll. The cash drawer further includes a receptacle for receiving a blade assembly. The blade assembly having a blade and a blade holder. The blade assembly is removable. The blade assembly is easily inserted and removed from the receptacle by use of the flexible arms of the blade holder. The blade holder is formed by two identical halves each having a male post, a post slot, a snap post and a snap arm for securing the blade. The blade having notches for receiving the male posts.

BRIEF DESCRIPTION OF THE DRAWINGS

The foregoing and other objects, aspects and advantages of the invention will be better understood from the following detailed description with reference to the drawings, in which:

FIG. 2(*b*) is an enlarged isometric view of the cash drawer with the removable blade assembly in its inserted position.

FIG. 2(*c*) is an enlarged isometric view of the cash drawer with the removable blade assembly in its inserted position.

FIG. 3(*b*) is a cross sectional view of the cash drawer with the parallel guides and receptacle.

FIG. 5(*b*) depicts a vertical guide and blade orientation.

FIG. 5(*c*) depicts a descending slant guide and blade orientation.

FIG. 5(*d*) depicts an ascending guide and blade orientation.

FIG. 5(*e*) depicts a bowed guide and with a horizontal blade orientation.

DETAILED DESCRIPTION OF THE INVENTION

Figure 1:
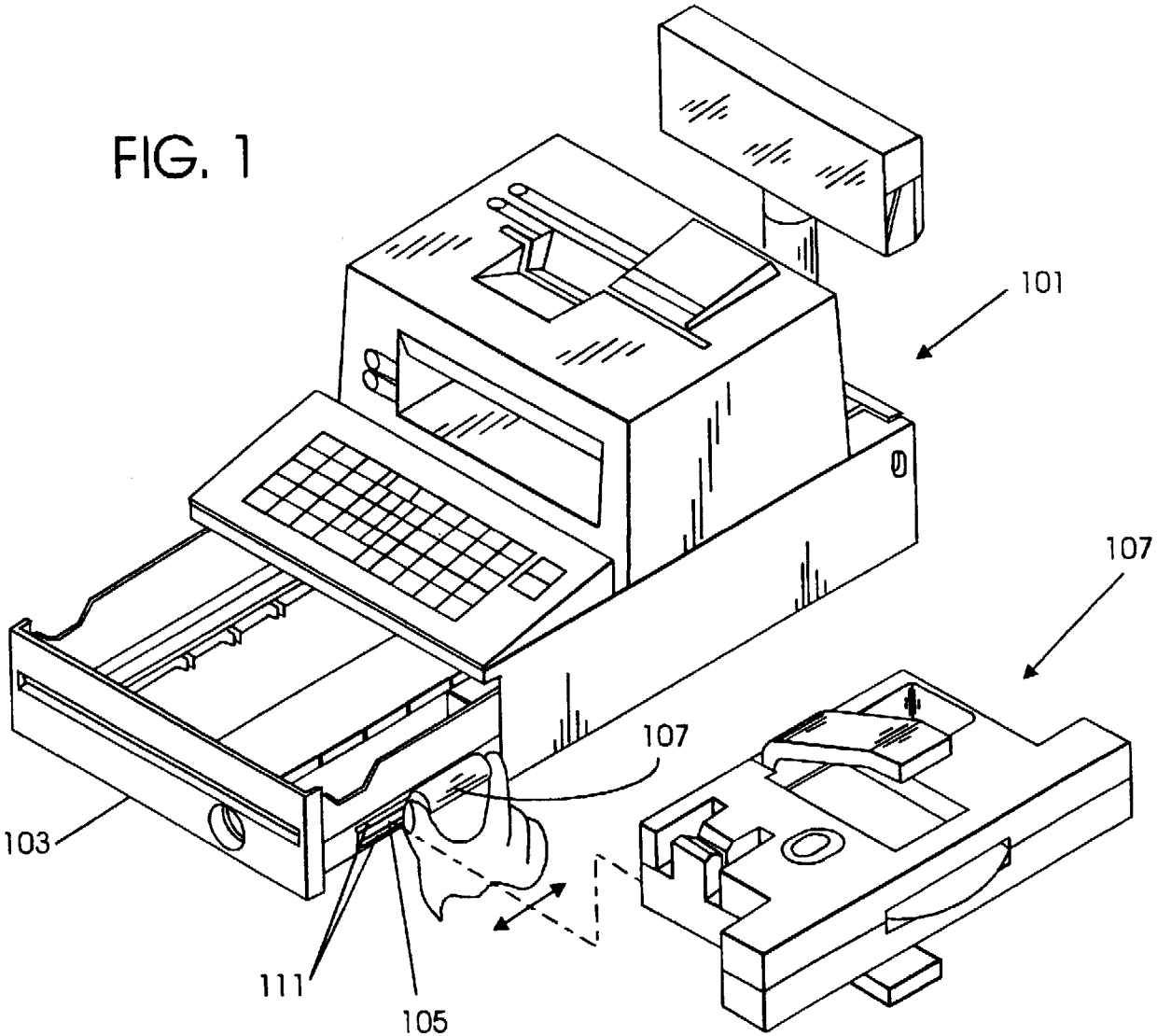
FIG. 1 is a isometric view of the preferred embodiment of the present invention showing the POS system, with a cash drawer and removable blade assembly.
Figures 2A, 2B:
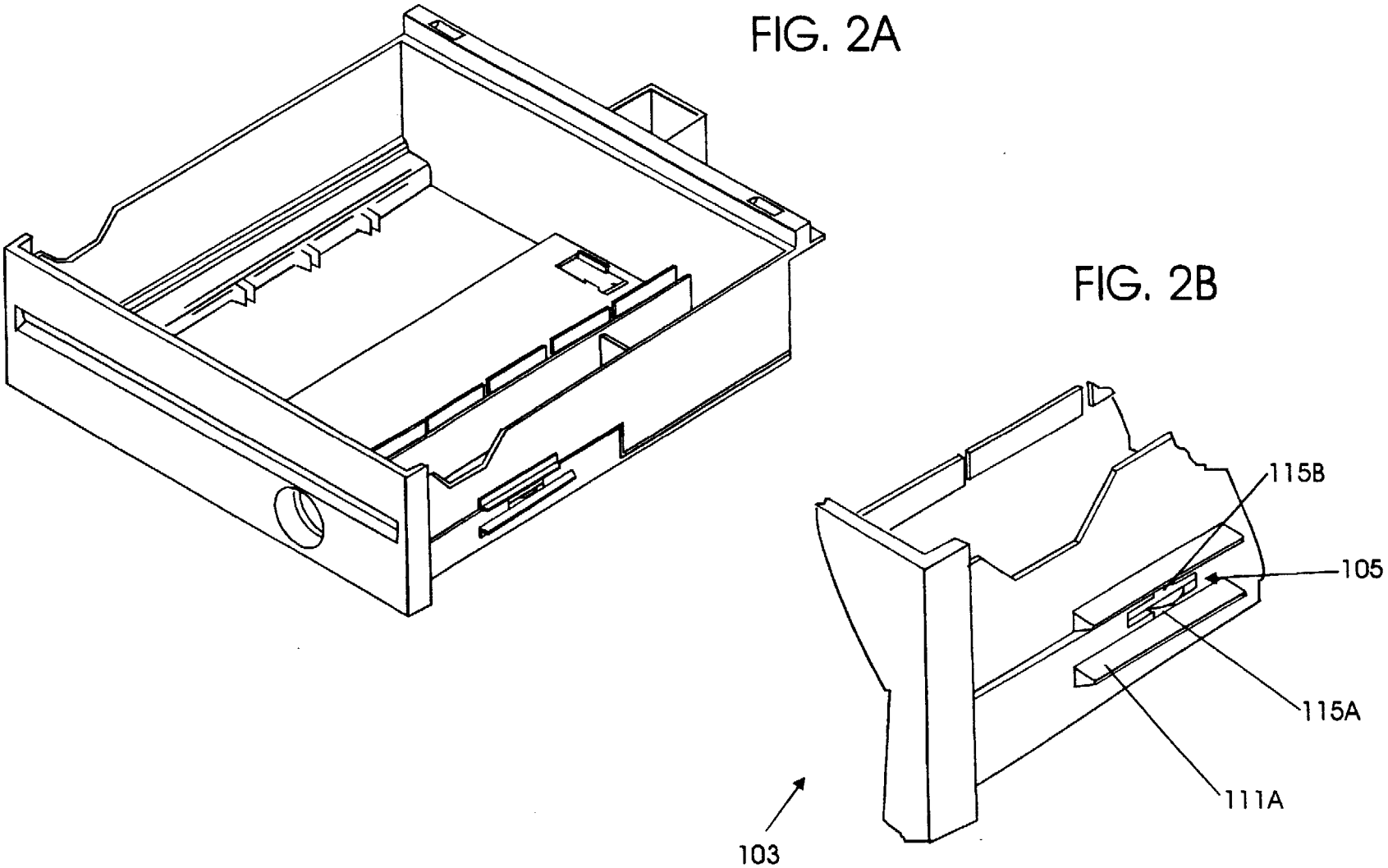
FIG. 2(*a*) is an isometric view of the cash drawer with the removable blade assembly in its inserted position.
Figure 2C:
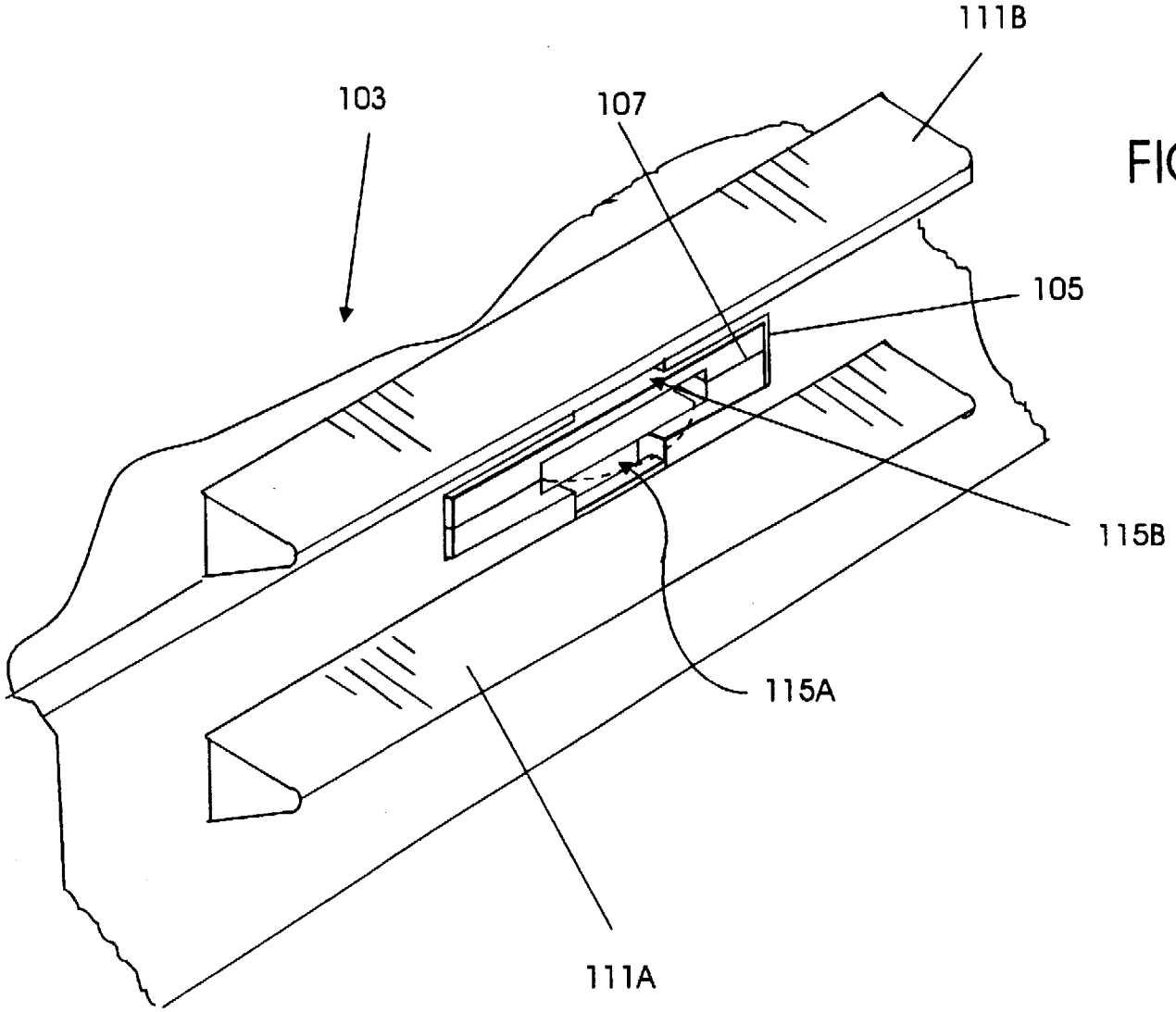

FIG. 1 depicts a Point-of-Sale environment in which the present invention operates. FIG. 1 depicts the cash drawer in a point-of-Sale (POS) system an enlarged blade assembly shown off to the side, as well as inserted into the cash drawer. FIG. 2 depicts the cash drawer with the blade assembly inserted. Although the present invention is shown in a POS environment, it is not limited to POS environments. The present invention may be used in other environments that require the use of coin containers and coin roll openers. For instance, the present invention is also suited for use in banks. The present invention may also be used in cash registers including electronic cash registers.

Figure 3A:
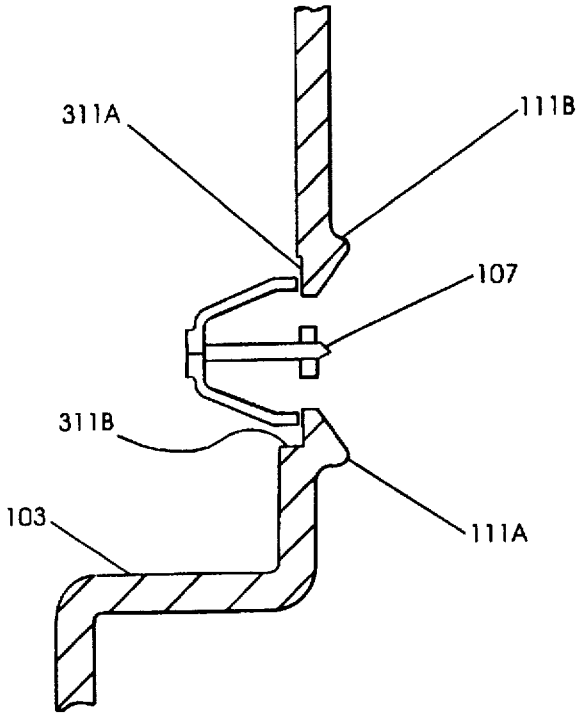
FIG. 3(*a*) is a cross sectional view of the cash drawer with the parallel guides and receptacle with the blade assembly inserted.
Figure 3B:
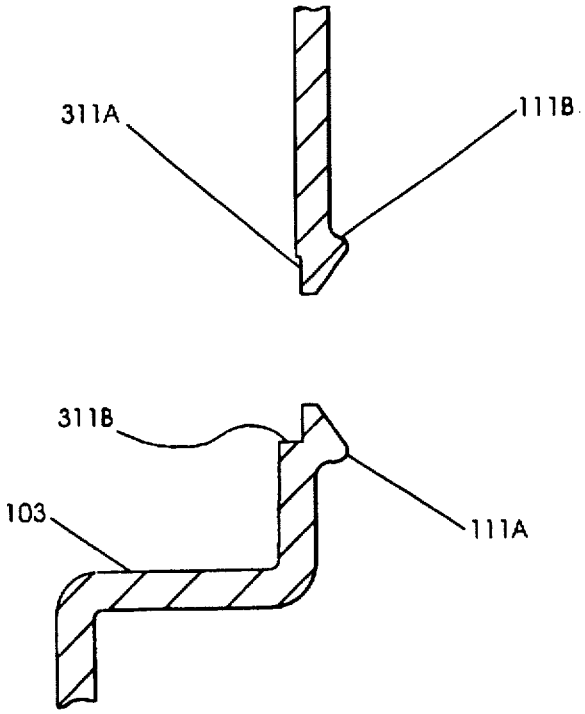

In FIG. 1 a Point Sale System 101, such as IBM 4694 Point of Sale System available from IBM Corporation, is shown as having a cash drawer 103 in accordance with the present invention. Note that the receptacle in the cash drawer 105 and the blade assembly 107. The blade assembly is shown in more detail in FIG. 4 and the cash drawer is shown in FIG. 2 and FIG. 3. Note that electronic components for electronically controlling the cash drawer are not shown. Coin rolls are opened by the cashier by applying the coin roll 109 to the guides 111 so that the coin roll is applied across the blade. The cashier may push and/or pull the coin roll 109 across the blade thus cutting, slicing, tearing, piercing or scoring the coin roll wrapper.

The Cash Drawer

FIG. 2 depicts a cash drawer 103 with the receptacle 105 for receiving a blade assembly. FIG. 3 shows a cutaway view of the cash drawer and receptacle. As shown in FIG. 2 the receptacle is located on the right side of the cash drawer. Although shown on the right side the present invention is not limited to any particular side and may be located on the bottom. The preferred location is the right side as shown or the left side because of easier accessability for the cashier facing the cash drawer. The coin roll opener is preferable located on the side on which the cashier has the most dexterity or to correspond with the hand to which the cashier uses to open coin rolls. This avoids the need for the cashier to reach over the open cash drawer. In an alternative embodiment the cash drawer may have receptacles on both the right and left side to accommodate two blade assemblies, or one blade assembly where the cashier or some other person may insert the blade assembly on the side that best suites their particular needs.

The receptacle may be located on any portion of the desired surface of the cash drawer. The particular location will depend on the particular dimensions of the cash drawer and the cash drawer opening in the POS system. Also the location and construction of guides, tracks and the location of tills and trays in the cash drawer may dictate the location and orientation of the receptacle.

In the preferred embodiment guides 111A, 111B are provided near the location of the blade assembly receptacle. The guides 111A, 111B receive the coin roll and guide it towards and/or over the blade. In FIG. 2, the preferred embodiment the guides are parallel with the receptacle located between each of the guides. The actual length and spacing between the guides is determined based on the size of the coin rolls to be opened and the dimension and orientation of the blade assembly when inserted. Also, in the preferred embodiment the guides are parallel with the blade when the blade assembly is inserted into the receptacle thus allowing the cashier to pull and/or push the coin roll in either direction along the guides. FIG. 2 depicts the cutting or tearing end of the blade aligned in parallel with guides. The guides may be oriented vertically or horizontally or in any other orientation on the desired outer surface of the cash drawer. Alternative embodiments are shown in FIG. 5. FIG. 2 depicts a horizontal orientation on the right side. The actual orientation will depend on the direction in which the cashier is most likely to use in opening coin rolls.

Note that in the preferred embodiment the receptacle is designed to receive the blade assembly. In particular note the slots 115 for receiving the flexible arms of the blade assembly. These slots enable the blade assembly to snap into and be held securely in the receptacle. By squeezing the flexible arms the blade assembly can be easily removed from or inserted into the receptacle. The receptacle can be of any shape or dimensions as long as it operates reciprocally with the blade assembly. The blade assembly and receptacle cooperate to minimize movement of the blade and the blade assembly when the cashier is opening coin rolls. FIG. 3 shows a cutaway view of the cash drawer with the receptacle and with and without the blade assembly.

The cash drawer may be constructed using any material (e.g., metal, wood, plastic). In the preferred embodiment the cash drawer is made of a plastic material using well known injection molding techniques.

The Blade Assembly

The blade assembly consists of a blade and a blade holder. The blade has a sharp edge that is used for cutting, slicing, tearing, piercing or scoring the coin roll wrapper. The blade may be made out of any hard material that can used to produce a sharp edge. In the preferred embodiment the blade is made of steel. The blade holder is adapted to the blade. The receptacle in the cash drawer is also adapted to receive the blade assembly. The blade holder functions to securely hold the blade in place within the blade assembly and also to secure the blade assembly when it is inserted in the cash drawer. The blade assembly and receptacle cooperate to minimize movement of the blade and the blade assembly when the cashier is opening a coin roll.

Figure 4:
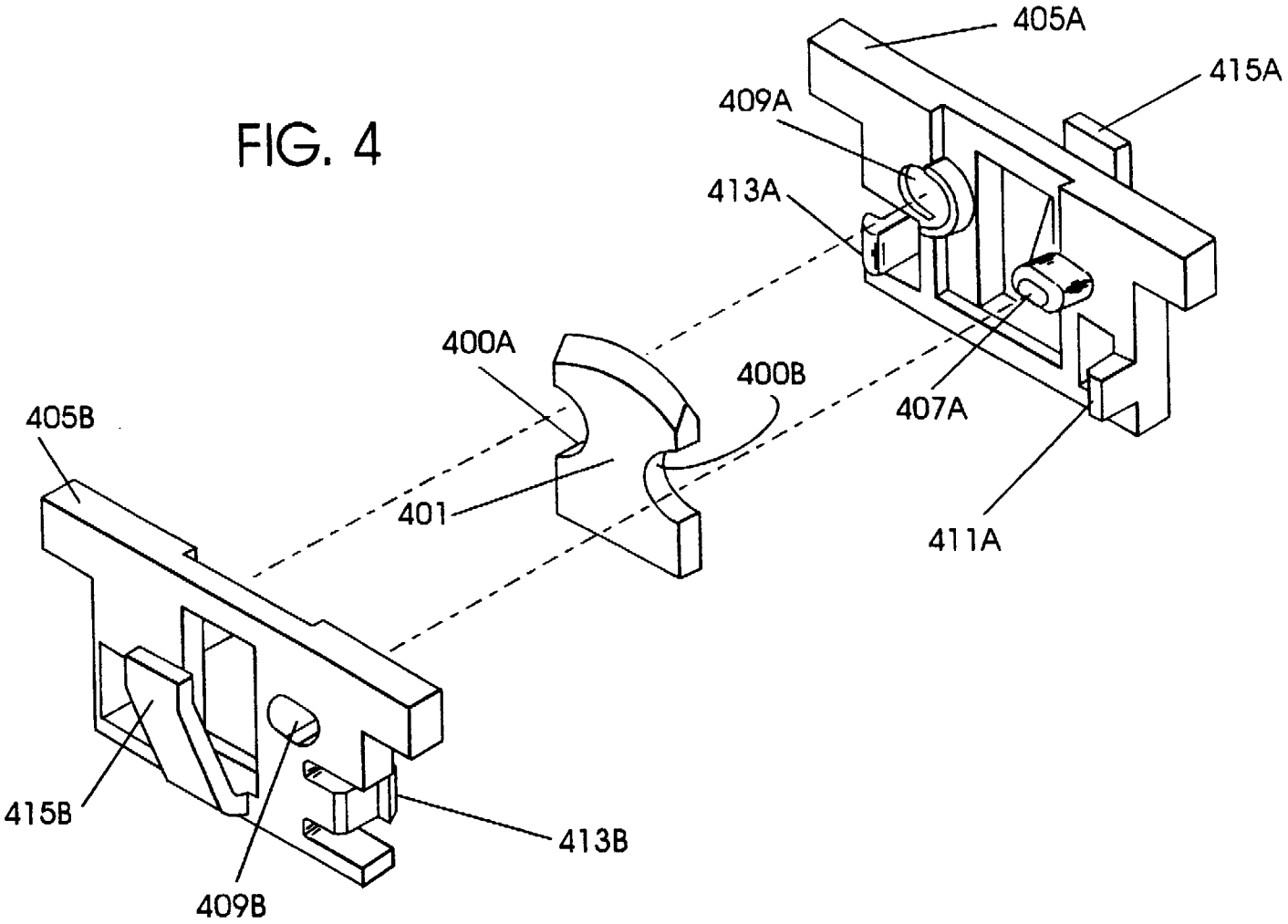
FIG. 4 is a depiction of the blade assembly.
Figure 5A:
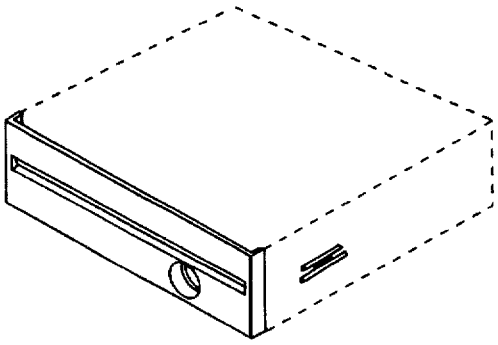
FIG. 5(*a*) depicts a horizontal guide and blade orientation.
Figure 5B:
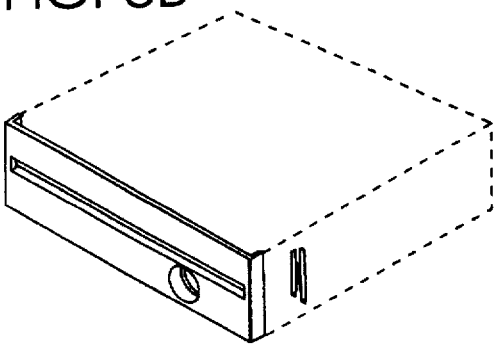
Figure 5C:
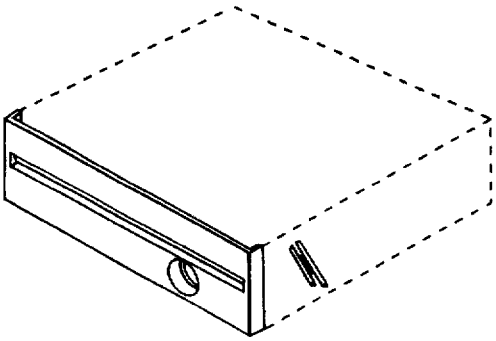
Figure 5D:
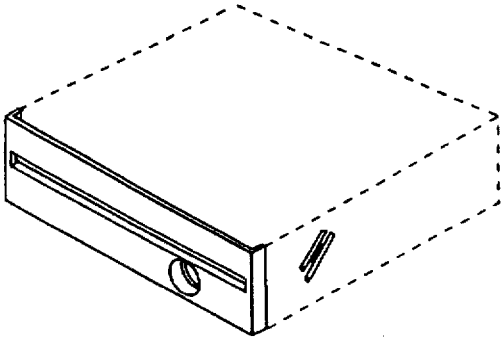
Figure 5E:
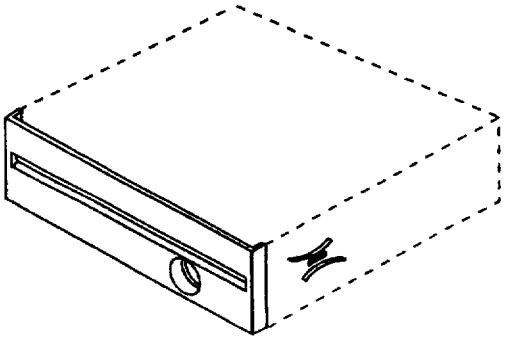

In the preferred embodiment depicted in FIG. 4 the blade holder is comprised of two blade jacket halves depicted as 405A and 405B. The jacket halves are identical so that they may be mated together securing the blade 401 between them. Note that the flexible arm 415 in each jacket half is used for securing the blade assembly to the receptacle. The flexible arms 415A and 415B permit the blade assembly to be easily inserted and removed from the receptacle in the cash drawer by squeezing or pinching the flexible arms towards each other and inserting or removing the blade assembly. Note that the receptacle has slots for receiving the flexible arms 415 so that the slots cause the flexible arms to be pinched and thus exert a securing force against the slot walls when inserted into the receptacle. Each jacket also contains a male post 407 and a post slot 409. Thus, when the halves are mated together the respective post slots 409A and 409B receive the respective male posts 407B and 407A such that the blade 401 is secured between the jackets on the male posts. Note the blade 401 has notches 400A, 400B that are used in conjunction with the posts of the blade holder to secure the blade 401. In the preferred embodiment, when the blade assembly is assembled the only portion of the blade that is exposed is the cutting edge. The location of blade notches 400A, 400B on the blade 401 in conjunction with the location of the male posts 407A, 407B in each of the jacket halves operate to assure that only the scoring portion of the blade is exposed. When the jacket halves and blade are assembled, the male posts 407 retain the blade 401 inside the housing formed by the two jacket halves 405. The exposed edge on the blade is not sharp enough to cause injuries; it is only sharp enough to score the coin roll wrapper. Each jacket half also contains a snap post 411 and a snap arm 413. The snap post 411A of jacket half 405A is inserted into the snap arm 413B of jacket half 405B and the snap post 411B of jacket half 405B is inserted into the snap arm 413A of jacket half 405A. The snap posts 411 and associated snap arms 413 provide for securing the jackets together in addition to the posts 407 and post slots 409.

The blade assembly is put together by first locating the blade on one jacket halve and then snapping the other jacket halve over it. The blade is now located and secured within the jacket halves. The jacket halves may be constructed using any material (e.g., metal, wood, plastic). In the preferred embodiment the jacket halves are made of a plastic material using well known injection molding techniques.

Use of the Present Invention & Advantages

In the preferred embodiment the blade assembly is only accessible when the cash drawer is open. This is shown in FIG. 1. The cash drawer is usually opened by the cashier when the cashier is seeking to add items to the cash drawer (e.g., tills cash, coins, checks, coupons, charge slips etc.) or to take items out. When adding coins to a cash drawer the cashier must open the cash drawer to add the coins. The coin rolls may be stored inside the cash drawer or provided to the cashier from some other coin roll repository. In any case the cashier must open the cash drawer to add the coins from the coin roll. After the cash drawer is open and the cashier has obtained a coin roll, the cashier applies the coin roll using the guides on the cash drawer so that the blade situated between the guides can open the coin roll. The cashier may push and/or pull the coin roll across the blade to cut, slice, tear, pierce and/or score the coin roll wrapper. The cashier can then remove the coins from the coin roll wrapper and deposit the coins from the coin roll in the cash drawer. By having the coin roll opener in the cash drawer the present invention eliminates the need to bang the coin roll on some other object.

The present invention provides a cutting blade that is easy to access when needed, but out of the way when not needed. The present invention doesn't effect access to the cash drawer for dispensing items. The present invention does not occupy any valuable counter space. The present invention enhances safety because the blade is not accessible by the cashier when the cash drawer is closed.

The present invention encourages the use of a coin roll opener that does not entail the use of banging and/or smashing and thus is much easier on the cashier, equipment and other objects. The present invention is easier on equipment so that equipment need not be replaced or repaired as frequently. This is particularly true of the cash drawers.

The present invention also is easy to maintain with the simple easy to insert and easy to remove blade assembly. As the blade dulls with repeated use, the blade or the entire blade assembly may be replaced. In the preferred embodiment the entire blade assembly is replaced. Replacement is accomplished by squeezing the flexible arms and then discarding the blade assembly and inserting a new blade assembly in the appropriate receptacle. In an alternative embodiment the blade may be replaced by popping open the jacket sleeves removing the old blade and replacing the old blade with a new blade and then snapping the jackets into their closed position about the new blade. The present invention provides for the convenient replacement of worn out blades.

While the invention has been described in detail herein in accord with certain preferred embodiments thereof, modifications and changes therein may be effected by those skilled in the art. Accordingly, it is intended by the appended claims to cover all such modifications and changes as fall within the true spirit and scope of the invention.

What is claimed is:

1. A coin roll opening device comprising:

a cash drawer having two guides located on a first side of said cash drawer, said guides adapted for receiving a coin roll, said cash drawer having a blade assembly receptacle located between said guides, said blade assembly receptacle having two slots;

a blade assembly having a blade, a blade holder, and two flexible arms disposed on the blade holder, the blade having a scoring edge, said blade holder for securing said blade in the blade assembly such that the scoring edge of the blade is exposed, the flexible arms cooperating with the slots of the blade assembly receptacle to secure said blade assembly within the blade assembly receptacle.

2. The device according to claim 1 wherein said blade assembly is removable from the blade assembly receptacle.

3. The device according to claim 2 wherein the flexible arms are disposed at a base of the blade holder and extend from the base of the blade holder at an acute angle relative to a most-adjacent side of said blade holder, such that a free end of each of said flexible arms is closer to said scoring edge of said blade than is a base end of each of said flexible arms, the flexible arms are used to insert and remove the blade assembly from said blade assembly receptacle.

4. The device according to claim 3 wherein the blade holder is further comprised of two jacket halves each having a male post and a male post slot for securing said blade in the blade assembly.

5. The coin roll opening device of claim 3 wherein said blade assembly is inserted or removed from the blade assembly receptacle by applying a compressive force to the flexible arms.

6. The device according to claim 1 wherein the guides are parallel.

7. The device of claim 1 wherein said first side is inaccessible when said cash drawer is in the closed position.

8. The device according to claim 1 wherein said blade is made of metal, said cash drawer and said blade holder are made of molded plastic.

9. The device according to claim 1 comprising:

a second set of guides located on a second side of said cash drawer, said second set of guides adapted for receiving a coin roll said cash drawer having a second blade assembly receptacle located between said second set of guides, said second blade assembly receptacle having two slots.

10. The device according to claim 9 further comprising a second blade assembly having a second blade, a second blade holder, two flexible arms disposed on the second blade holder, the second blade having a scoring edge, said second blade holder for securing said second blade in the second blade assembly such that the scoring edge of the second blade is exposed, the flexible arms cooperating with the slots of the second blade assembly receptacle to secure said second blade assembly within the second blade assembly receptacle.

11. A Point of Sale system comprising:

a cash drawer having two guides located on a first side of said cash drawer, said guides adapted for receiving a coin roll, said cash drawer having a blade assembly receptacle located between said guides, the blade assembly receptacle having two slots;

a housing for receiving said cash drawer, said housing concealing said first side when said cash drawer is in a closed position and exposing the guides when the cash drawer is in an open position;

a removable blade assembly having a blade, a blade holder, and two flexible arms disposed on the blade holder, the blade having a scoring edge, said blade holder for securing said blade in the blade assembly such that the scoring edge of the blade is exposed, the flexible arms cooperating with the slots of the blade assembly receptacle to secure said blade assembly within the blade assembly receptacle.

* * * * *